United States Patent [19]

Fay

[11] Patent Number: 4,497,431

[45] Date of Patent: Feb. 5, 1985

[54] CONTAINER STRUCTURE

[75] Inventor: James E. Fay, Neenah, Wis.

[73] Assignee: James River—Norwalk, Inc., Norwalk, Conn.

[21] Appl. No.: 336,675

[22] Filed: Jan. 4, 1982

[51] Int. Cl.[3] ..... B65D 5/42

[52] U.S. Cl. ..... 229/6 R; 219/10.55 E; 229/87 F; 229/DIG. 14; 426/113; 383/103

[58] Field of Search ..... 426/113, 114, 118; 229/62.5, DIG. 14, 87 F, 87 B, 6 A, 6 R; 219/10.55 E; 383/103

[56] References Cited

U.S. PATENT DOCUMENTS

| | | | |
|---|---|---|---|
| 2,777,769 | 1/1957 | Hodges | 426/113 |
| 3,323,442 | 6/1967 | Roder | 229/DIG. 14 |
| 3,355,089 | 11/1967 | Champlin | 206/628 |
| 3,399,822 | 9/1968 | Kugler | 229/62.5 |
| 4,228,945 | 10/1980 | Wysocki | 426/113 |
| 4,266,713 | 5/1981 | Maroszek | 229/36 |

FOREIGN PATENT DOCUMENTS

| | | | |
|---|---|---|---|
| 639709 | 4/1962 | Canada | 229/DIG. 14 |

*Primary Examiner*—Stephen P. Garbe

*Attorney, Agent, or Firm*—Finnegan, Henderson, Farabow, Garrett & Dunner

[57] ABSTRACT

A closed paperboard carton for containing hot foods includes an automatically openable vent responsive to presence of hot vapor emanating from the food to accommodate escape of the vapor. The vent comprises a tab portion formed in a wall of the carton, defined by at least a pair of equal-length knife cuts and having a region of connection with the wall. Vapors emanating from the hot food condense, and are absorbed by the inwardly facing wall surfaces of the paperboard carton. Absorption of condensed vapors in the region of the tab causes the inwardly facing surface of the tab to swell so that it curls outwardly and forms a vent. Once the vapor has substantially escaped, the inwardly facing wall surfaces tend to dry out, accompanied by uncurling of the tab to its original, vent-closing position.

22 Claims, 6 Drawing Figures

FIG.1
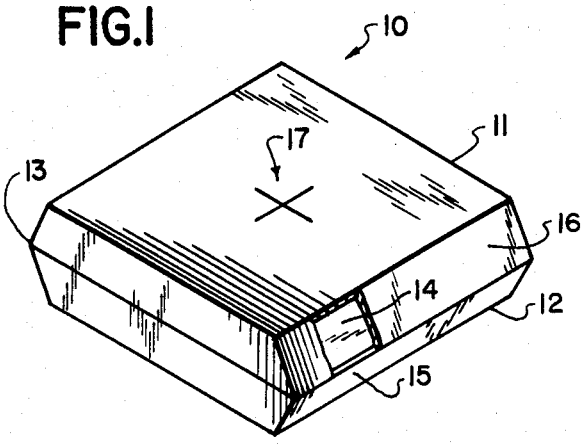
FIG.2
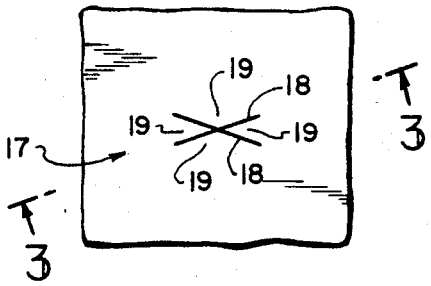
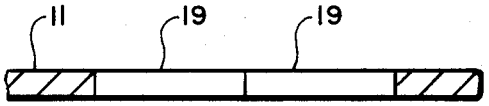
FIG.3
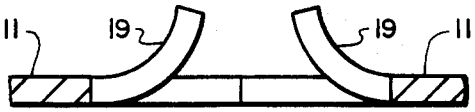
FIG.4
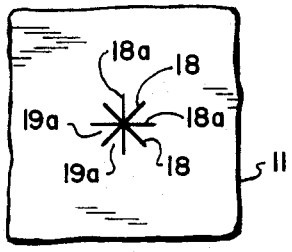
FIG.5
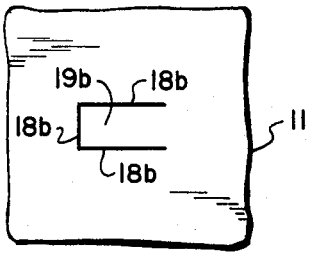
FIG.6

CONTAINER STRUCTURE

BACKGROUND OF THE INVENTION

This invention relates to a container structure, and more particularly to improved means for automatically venting vapors arising from hot moist food in a closed container.

In containers such as paperboard cartons for containing hot foods, the cover or a wall of a carton typically is provided with vents such as punched-out holes, or cut and scored areas that are manually foldable inwardly to provide holes. Vents of this type, while effective to prevent certain foods from becoming soggy, often permit the food to cool before it is served, since the vents remain open. Automatic venting means have been provided in sealed cook-in cartons, and have involved generally the use of heat-fusible means operable to open and vent at the relatively high temperatures encountered in cooking or reconstituting frozen foods. Vent means of this latter type is of course somewhat impractical for relatively lower food-serving temperatures. Also, once opened these same vent means remain open.

It is a general objective of this invention to provide automatic vent means for vapors emanating from hot food in a closed container.

It is a further, more specific objective of the invention to provide an improved automatically openable vent means for a closed paperboard carton responsive to presence of vapors emanating from hot food in the carton, which vent means also is automatically closable upon cool-down of the food.

SUMMARY OF THE INVENTION

In achievement of the foregoing as well as other objectives, the invention contemplates in a closed container of the type used for containing hot moist foods from which vapors emanate, the inclusion of an array of knife cuts in a paperboard wall of the container so positioned and arranged to form a tab section of paperboard formed integrally with the wall and having edges free of connection and a region of connection with the wall, whereby vapors absorbed by the surface portion of the paperboard tab section facing inside the container are effective to expand the paperboard and cause the tab section to curl outwardly of the container, about the recited region of connection to the wall, thereby to form an opening to vent the container. Upon initial cool-down of the contents, the vapors substantially abate, permitting the tab section to dry out and uncurl to its closed position.

The manner in which the foregoing objectives and advantages of the invention may best be achieved will be more fully understood from a consideration of the following description, taken in light of the accompanying drawing.

BRIEF DESCRIPTION OF THE DRAWING

FIG. 1 is a fragmented perspective view of a closed paperboard carton embodying the invention;

FIG. 2 is a top plan view, on an enlarged scale, of a portion of the carton seen in FIG. 1;

FIG. 3 is a fragmentary sectional view taken generally along the line 3—3 of FIG. 2;

FIG. 4 is a view similar to FIG. 3, illustrating an operational feature of the invention; and FIGS. 5 and 6 are top plan views similar to FIG. 2, showing modified embodiments of the invention.

DESCRIPTION OF THE SEVERAL EMBODIMENTS

With more detailed reference to the drawing, and first to FIG. 1, one form of a closed container embodying the invention comprises a carton 10 of the so-called clamshell type set up from a suitably cut and scored paperboard blank. Cartons of this general type are used extensively for packaging hot hamburgers, french fries, and other hot, moist foods, such as are served at fast-food restaurants.

Carton 10 includes an upper lid portion 11 and a lower container portion 12 interconnected by a hinge 13. One such carton is disclosed and claimed in U.S. Pat. No. 4,266,713, issued May 12, 1981, and assigned to the assignee of the present invention. It is in order, however, to point out that carton 10 is exemplary of cartons used for this purpose, and that closed cartons of other configurations and combinations of paperboard and other materials, are contemplated by the invention. Further to construction of carton 10, locking closure of the lid portion 11 is afforded by a bridging panel 14 that projects from the front wall 15 of container portion 12 into releasable frictional engagement with the inner surface of a front wall 16 of portion 12.

In use, and by way of example, hot food, such as a hot hamburger or hot french fries, is placed in the lower portion 12 and lid portion 11 is hingedly closed and locked. Since the food is moist and hot it gives off hot water vapor which tends to condense on the relatively cooler walls of the carton. As a result, the food in the carton tends to become soggy, hence unappetizing.

The present invention proposes a simple and effective automatically openable vent means that accommodates escape of the vapor prior to its excessive condensation, which vent means automatically recloses in response to substantially complete escape of the vapors. With reference further to FIG. 2, the vent means is designated generally by the numeral 17 and is provided in a planar section of lid portion 11. Vent means 17 comprises at least a pair of identical, straight line knife cuts 18, each, for example, about 1 inch long and intersecting at their midpoints. While the intersection of the array of cuts 18 define unequal pairs of vertical angles, the array may be formed to define equal vertical angles. For example, knife cuts 18 might intersect at right angles, hence the pairs of vertical angles would be equal. Consider further that the carton is formed from a sheet of from about 10 pt. to about 14 pt. paperboard which may be uncoated, or provided with a porous coating such as is characteristic of clay-coated bleached sulphate board typically used for cartons of this type. Referring also to FIG. 3, it is seen that cuts 18 form planar, mutually presented, generally triangularly shaped tabs or tab sections 19 of different widths in the planar section of the carton lid portion 11.

Upon placing hot, moist food in the carton and closing same, vapors emanating therefrom condense and are absorbed by fibers adjacent the inner surface of the paperboard carton, including lid portion 11 and tabs 19 facing inside the carton, causing the paperboard to swell in the region of the inner surface. With reference to FIG. 4, and in especial accordance with the invention, swelling of the paperboard inner surface causes tabs 19 to curl upwardly about their regions of connection to lid portion 11, automatically creating vent means through which the remaining vapors may escape. For convenience of illustration, the amount of curl has been exaggerated, and while shown as uniform, it may differ according to the different widths of tabs 19. When vapors are no longer being given off, the heat of the food tends to dry out the paperboard, whereupon the tabs 19 uncurl and return to their original, closed position (i.e., FIGS. 1 to 2). This same closure advantageously aids in minimizing further escape of heat from the contained food.

In the modified embodiment in FIG. 5, an additional pair of cuts 18*a* may be provided, whereby tabs 19*a* are more narrow and sensitive to the presence of vapors. In this array of cuts, pair of cuts 18 and 18*a* intersect at a common point, define substantially equal vertical angles, and form tabs of equal width.

A further embodiment is seen in FIG. 6, and comprises a single rectangularly shaped tab 19*b* defined by knife cuts 18*b*. In this array of cuts, a pair of cuts 18*b* are linear, parallel, and of equal length, and a third cut 18*b* extends between directly opposed ends of parallel cuts 18*b*.

While in the embodiments illustrated in FIGS. 1 to 5 the knife cuts intersect at their midpoints, it is to be understood that intersection need not be at the midpoints, but it is preferred that the cuts intersect so that at least one of the angles formed by the intersecting cuts be defined by segments of equal length. By such a construction, at least one of the tab sections preferably will have symmetry about its region of attachment to the main body of paperboard, thereby enhancing its venting operation when subjected to vapors.

For any of the several embodiments there is achieved both automatic opening and automatic closing of the vent means, and it will be appreciated that other modifications of the invention may be resorted to, within the scope of the claims.

I claim:

1. A container for hot moist foods from which moisture emanates, said container including at least one wall area of paperboard formed from a sheet of from about 10 point to about 14 point paperboard, one surface of said sheet facing the inside of said container and forming the inner surface thereof, said inner surface being capable of absorbing moisture emanating from hot moist foods when the foods are contained inside the container, the improvement comprising at least two tab sections formed by an array of knife cuts in the wall area, said knife cuts comprising straight continuous cuts, at least two of said cuts intersecting one another at an angle of 90 degrees or less to form two cut edges of each said tab section, each said tab section having said cut edges free of connection with said wall area and a region of connection with the wall area, each said tab section being for the purpose of curling outwardly about said region of connection upon absorption of said moisture by the inner surface of each said paperboard tab section and thereby forming a vent accommodating escape of vapors from said container; each said tab section uncurling back to said wall area upon drying of said inner surface and thereby closing said vent.

2. The container of claim 1, wherein the angle formed by said two intersecting cuts is defined by cut segments of equal length.

3. The container of claim 1 or 2, wherein said paperboard is clay coated.

4. The container of claim 1 or 2, wherein said paperboard is uncoated.

5. The container of claim 1 or 2, wherein said paperboard is provided with a porous coating.

6. The container of claim 1 or 2, wherein said paperboard is of the bleached sulphate type.

7. The container of claim 6, wherein said paperboard is clay coated.

8. The container of claim 6, wherein said paperboard is uncoated.

9. The container of claim 6, wherein said paperboard is provided with a porous coating.

10. The container of claim 1, wherein said two intersecting knife cuts intersect to form a triangular-shaped tab section.

11. A container for hot moist foods from which moisture emanates, said container including at least one wall area of paperboard formed from a sheet of from about 10 point to about 14 point paperboard, one surface of said sheet facing the inside of said container and forming the inner surface thereof, said inner surface being capable of absorbing moisture emanating from hot moist foods when the foods are contained inside the container, the improvement comprising a tab section formed by knife cuts in the wall area, said knife cuts comprising two straight continuous cuts intersecting one another at one end thereof at an angle of 90 degrees or less to form two cut edges of said tab section, said tab section having said cut edges free of connection with said wall area and a region of connection with the wall area, said tab section being for the purpose of curling outwardly about said region of connection upon absorption of said moisture by the inner surface of said paperboard tab section and thereby forming a vent accommodating escape of vapors from said container; said tab section uncurling back to said wall area upon drying of said inner surface and thereby closing said vent.

12. The container of claim 11, wherein said angle formed by said two intersecting cuts is defined by cut segments of equal length.

13. The container of claim 11, wherein said knife cuts include a pair of parallel linear cuts of equal length and a single cut extending between the directly opposed ends of said parallel cuts opposite said region of connection.

14. The container of claim 11, 12 or 13, wherein said paperboard is clay coated.

15. The container of claim 11, 12 or 13, wherein said paperboard is uncoated.

16. The container of claim 11, 12 or 13 wherein said paperboard is provided with a porous coating.

17. The container of claim 11, 12 or 13, wherein said paperboard is of the bleached sulphate type.

18. The container of claim 17, wherein said paperboard is clay coated.

19. The container of claim 17, wherein said paperboard is uncoated.

20. The container of claim 17, wherein said paperboard is provided with a porous coating.

21. The container of claim 11, wherein said two knife cuts intersect to form a triangular-shaped tab section.

22. The container of claim 21, wherein said paperboard is provided with a porous coating.

* * * * *